US007685917B2

(12) United States Patent
Reeves et al.

(10) Patent No.: US 7,685,917 B2
(45) Date of Patent: Mar. 30, 2010

(54) APPARATUS AND METHOD FOR CLEARING LAND MINES

(75) Inventors: Samuel Jesse Reeves, Philadelphia, PA (US); Joshua Koch Koplin, Philadelphia, PA (US)

(73) Assignee: Humanistic Robotics, Inc., Philadelphia, PA (US)

( * ) Notice: Subject to any disclaimer, the term of this patent is extended or adjusted under 35 U.S.C. 154(b) by 0 days.

(21) Appl. No.: 11/912,106

(22) PCT Filed: Apr. 21, 2006

(86) PCT No.: PCT/US2006/015123

§ 371 (c)(1),
(2), (4) Date: Feb. 11, 2008

(87) PCT Pub. No.: WO2007/027217

PCT Pub. Date: Mar. 8, 2007

(65) Prior Publication Data

US 2008/0236376 A1 Oct. 2, 2008

Related U.S. Application Data

(60) Provisional application No. 60/674,035, filed on Apr. 22, 2005.

(51) Int. Cl.
*F41H 11/16* (2006.01)

(52) U.S. Cl. ..... 89/1.13; 102/402

(58) Field of Classification Search ..... 89/1.13; 102/402, 403

See application file for complete search history.

(56) References Cited

U.S. PATENT DOCUMENTS

| | | | | |
|---|---|---|---|---|
| 1,190,257 A | | 7/1916 | Henderson | |
| 2,200,230 A | | 5/1940 | Hojnowski | |
| 2,261,933 A | | 11/1941 | Flynn | |
| 2,489,349 A | * | 11/1949 | White | 89/1.13 |
| 2,745,330 A | | 5/1956 | Nelson | |
| 2,919,754 A | | 1/1960 | Walberg | |

(Continued)

FOREIGN PATENT DOCUMENTS

DE 2048921 A1 4/1972

(Continued)

OTHER PUBLICATIONS

Habib, M.K. "Mechanization Technologies of Mine Clearing Operations . . . " Proceedings of the 11th World Congress in Mechanism and Machine Science, pp. 973-978, 2004.

(Continued)

*Primary Examiner*—Stephen M Johnson
(74) *Attorney, Agent, or Firm*—Morgan Lewis & Bockius LLP

(57) ABSTRACT

A method and an apparatus for clearing land mines includes a mine detonator, a unmanned propulsion device and a rake member-electromagnet combination. The mine detonator includes a roller assembly, which is connected to and propelled by a prime mover of the unmanned propulsion unit. The mine detonator additionally may include a segmented column of weights that function to exert ground pressure to detonate hidden land mines. The rake member-electromagnet combination includes a rake member to turn up soil as the device advances in a minefield, and a magnetic member to pick up surface or sub-surface metal on the minefield.

13 Claims, 6 Drawing Sheets

U.S. PATENT DOCUMENTS

| | | | | |
|---|---|---|---|---|
| 3,199,608 | A | 8/1965 | Robbins | |
| 3,716,005 | A | 2/1973 | Fennell | |
| 3,771,413 | A | 11/1973 | Sieg et al. | |
| 4,593,766 | A * | 6/1986 | Gossard | 171/63 |
| 4,840,105 | A | 6/1989 | Ladan et al. | |
| 4,909,128 | A | 3/1990 | Grinwald | |
| 4,972,664 | A | 11/1990 | Frey | |
| 5,007,325 | A | 4/1991 | MacWatt | |
| 5,189,243 | A * | 2/1993 | Hambric | 89/1.13 |
| 5,313,868 | A | 5/1994 | Wolf | |
| 5,431,082 | A | 7/1995 | Zelverte et al. | |
| 5,706,899 | A | 1/1998 | Klebanov et al. | |
| 5,786,542 | A | 7/1998 | Petrovich et al. | |
| 5,892,360 | A | 4/1999 | Willer et al. | |
| 5,936,185 | A | 8/1999 | Tokuni | |
| 5,979,289 | A | 11/1999 | French | |
| 5,979,290 | A | 11/1999 | Simeone | |
| 5,988,037 | A | 11/1999 | Haughom et al. | |
| 6,182,769 | B1 | 2/2001 | Karlen | |
| 6,371,001 | B1 | 4/2002 | Schmid | |
| 6,481,326 | B2 | 11/2002 | French | |
| 6,915,728 | B2 | 7/2005 | Renwick et al. | |
| 6,952,990 | B1 | 10/2005 | Clodfelter | |
| 7,013,982 | B2 | 3/2006 | Northcutt | |
| 7,100,489 | B1 | 9/2006 | Kendall | |
| 7,168,501 | B2 | 1/2007 | Willibald | |
| 7,198,112 | B2 | 4/2007 | Wanner | |
| 2003/0196543 | A1 | 10/2003 | Moser et al. | |
| 2006/0266576 | A1 | 11/2006 | Eckhoff | |

FOREIGN PATENT DOCUMENTS

| | | | |
|---|---|---|---|
| DE | 2622162 | A1 | 12/1977 |
| DE | 2632568 | A1 | 1/1978 |
| DE | 10259436 | A1 | 7/2004 |
| EP | 1688699 | A1 | 8/2006 |
| FR | 909874 | A | 5/1946 |
| FR | 917695 | A | 1/1947 |
| FR | 997365 | A | 1/1952 |
| FR | 1157301 | A | 5/1958 |
| FR | 1240528 | A | 9/1960 |
| FR | 2618540 | A1 | 1/1989 |
| GB | 1337183 | A | 11/1973 |
| GB | 2294910 | A | 5/1996 |
| JP | 11211397 | A | 8/1999 |
| JP | 11257894 | A | 9/1999 |
| JP | 2000046496 | A | 2/2000 |
| JP | 2000337796 | A | 12/2000 |
| JP | 2002090095 | A | 3/2002 |
| JP | 2003042698 | A | 2/2003 |
| JP | 2004177106 | A | 6/2004 |
| JP | 2004353945 | A | 12/2004 |
| JP | 2006064205 | A | 3/2006 |
| JP | 2006300397 | A | 11/2006 |
| WO | WO 9311402 | A1 | 6/1993 |
| WO | WO 9637752 | A1 | 11/1996 |
| WO | WO 9738281 | A1 | 10/1997 |
| WO | WO 9814748 | A1 | 4/1998 |
| WO | WO 9814749 | A1 | 4/1998 |
| WO | WO 0043725 | A1 | 7/2000 |
| WO | WO 0161270 | A1 | 8/2001 |
| WO | WO 03086842 | A1 | 10/2003 |
| WO | WO 2004072574 | A1 | 8/2004 |
| WO | WO 2004106839 | A1 | 12/2004 |
| WO | WO 2007027217 | A3 | 5/2007 |

OTHER PUBLICATIONS

Evans, W.J. et al. "Blast-Resistant Mine Clearing Weels (Cast Steel)." Case Western Reserve University, Cleveland, OH, Jul. 9, 1974.

Edwards, D.C. "Expendable Mine-Clearing Roller (Ensure 202.1)." Army Mobility Equipment Reserach and Development Center, Fort Belvoir, VA, Jan. 1972.

Olofson, C.T. et al. "Feasibility of Forging Blast-Resistant Mine-Clearing Roller Wheels." Battelle Columbus Laboratories, Columbus, OH, Dec. 4, 1975.

International Search Report from International Application No. PCT/US2006/015123, dated Feb. 15, 2007.

Written Opinion of the International Search Authority Application No. PCT/US2006/015123, dated Feb. 15, 2007.

* cited by examiner

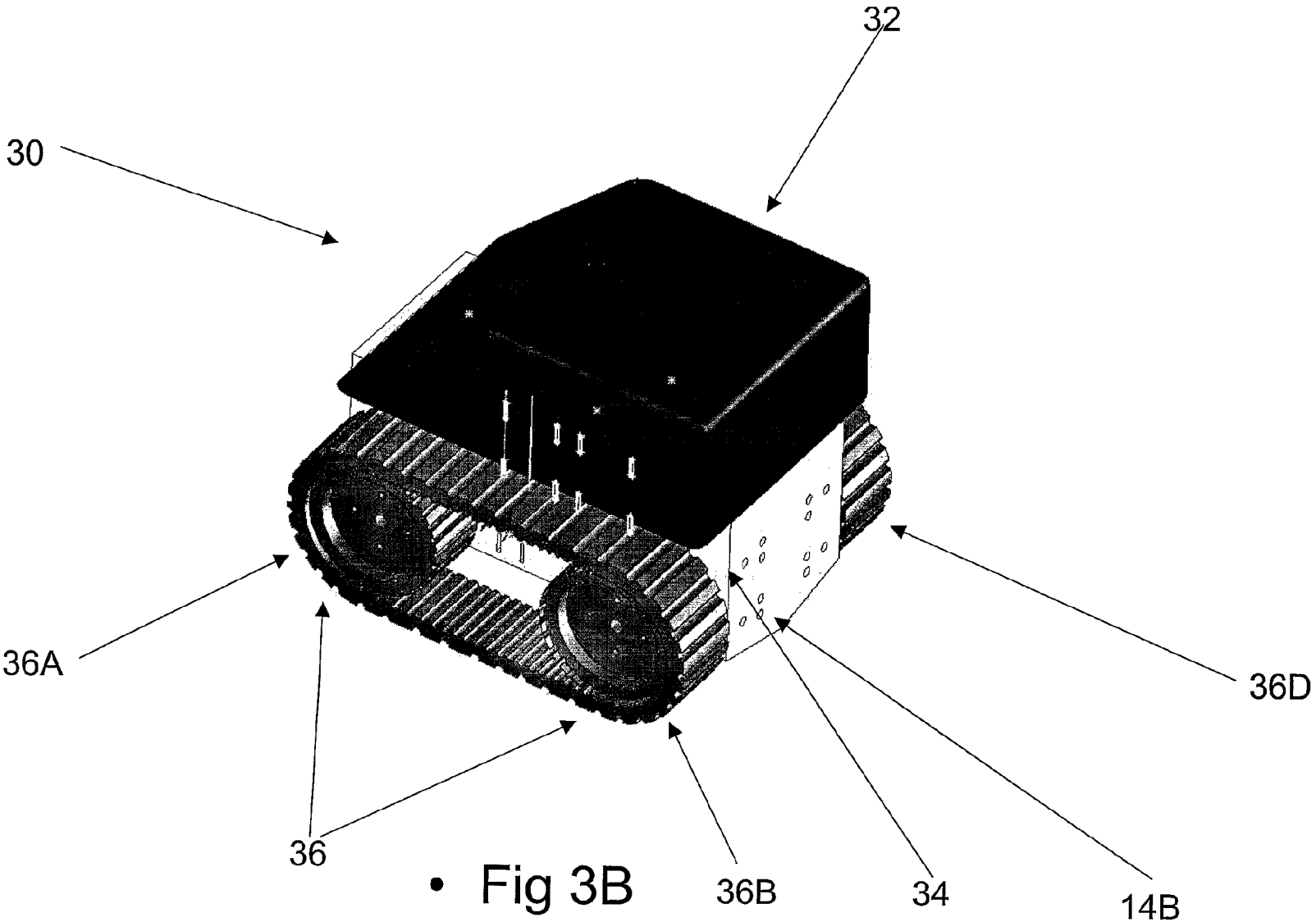
• Fig 3B

APPARATUS AND METHOD FOR CLEARING LAND MINES

CROSS-REFERENCE TO RELATED APPLICATIONS

This application is a National Stage of International Application No. PCT/US2006/015123, filed Apr. 21, 2006, which claims the benefit of U.S. Provisional Application No. 60/674,035, filed Apr. 22, 2005, which are both hereby incorporated by reference in their entireties.

BACKGROUND OF THE INVENTION

1. Field of the Invention

The present invention relates generally to an apparatus and a method for land mine clearance.

2. Description of Related Art

Two of the most persistent and overarching challenges in the demining industry are speed and cost of clearing land mines. As mechanical land mine clearance becomes more accepted and preferred among industry professionals as a way to speed up clearance, cost becomes a greater concern. Many machines on the market today require an enormous initial investment, continual expenditures in upkeep and repairs, and a team of trained mechanics to keep the machines running. Additionally, many machines are so large that they cannot be transported within the existing infrastructure of many nations where demining takes place, making it impossible to truly leverage the clearance potential of such machines. Many machines also are so complicated in their engineering that support in remote locations is difficult, time-consuming, and costly. Essentially, few manufacturers have considered the practical factors that make a machine truly useful. The humanitarian demining industry thus is in critical need of new mechanical clearance options that are more practical to use and less expensive both in initial purchase price and in lifetime upkeep.

The Pearson Roller/front-end loader combination ("Pearson") currently accomplishes much of the rolling in the demining industry. The "Pearson" device incorporates a set of segmented roller discs on one axle. The discs have an internal hole larger than the axle, this allows them to move up and down.

There are several important characteristics of new machines that many industry professionals view as crucial. New machines should fit within the potential of existing infrastructures to support them, meaning they should be light in weight and simple in design so that they can be maintained and repaired using easily procured parts. New machines should be simple to support, requiring minimal training to repair and maintain. New machines should be of robust design, meaning they should be able to withstand many mine blasts, as well as function well in all types of climates. Possibly most importantly, new machines should be inexpensive to purchase.

SUMMARY OF THE INVENTION

In one embodiment of the present invention there is provided an apparatus for clearing land mines comprising an unmanned propulsion unit having a first end and a second end, a mine detonator coupled to the first end of the device for detonating mines located at or near a ground surface and a rake member-electromagnet combination coupled to the second end of the device. The apparatus is operated by a remote control.

In another embodiment of the present invention, the apparatus further comprises a frame having a first side coupled to the mine detonator and a second side coupled to the first end of the unmanned propulsion device.

In another embodiment of the present invention, the mine detonator comprises a frame having a first side and a second side.

In a further embodiment of the present invention, the mine detonator comprises a roller assembly comprising at least one cylindrical roller mounted concentrically along a crosspiece of the first side of the frame.

In a preferred embodiment, the roller assembly comprises at least two cylindrical roller such that one roller comes into contact in an interlocking fashion with the other roller.

In a further preferred embodiment, the roller assembly comprises at least two cylindrical rollers such that a space separates the at least two rollers.

In an even further preferred embodiment, the roller assembly comprises at least two cylindrical rollers such that a circumference of the at least one cylindrical roller is different than a circumference of the at least second cylindrical roller.

In another embodiment of the present invention, the umanned propulsion unit comprises a prime mover having at least one wheel and a platform, wherein the platform has an armored undercarriage.

In a preferred embodiment of the present invention, the umanned propulsion unit further comprises at least one motor that engages with one wheel.

In an even further embodiment of the present invention, the rake member-electromagnet combination comprises a rake member and an electromagnet member.

In a preferred embodiment of the present invention, the rake member-electromagnet combination has the same width as the roller assembly of the mine detonator.

In an even further embodiment of the present invention, there is provided a method for demining land mines at or near a ground surface, comprising exerting ground pressure on the ground surface via a unit movable on the ground surface, the unit operated by a remote control, raking up the ground surface upon movement of the unit, thereby exposing metals on or underneath the ground surface, and picking up the metals.

BRIEF DESCRIPTION OF THE DRAWINGS

The invention will be more clearly understood with reference to the following detailed description of non-limiting preferred embodiments of the invention considered in conjunction with the attached drawings, of which:

FIG. 3B is a perspective view of a prime mover of the unit displaying a second end, according to an embodiment of the present invention.

DETAILED DESCRIPTION OF THE INVENTION

According to the present invention, a method and an apparatus to clear a land mine involves a multi-tooled apparatus comprising at least one of an unmanned propulsion unit/device, a mine detonator and a rake member-electromagnet combination. The unmanned propulsion unit functions to move the apparatus onto a mine field. The mine detonator is a part of the apparatus that functions to engage land mines and detonates mines using ground pressure. The rake member-electromagnet combination functions to rake the mine field and pick up the surface and sub-surface metals as the apparatus moves in the mine field. The apparatus and method are described in greater detail herein-below.

Figure 1:
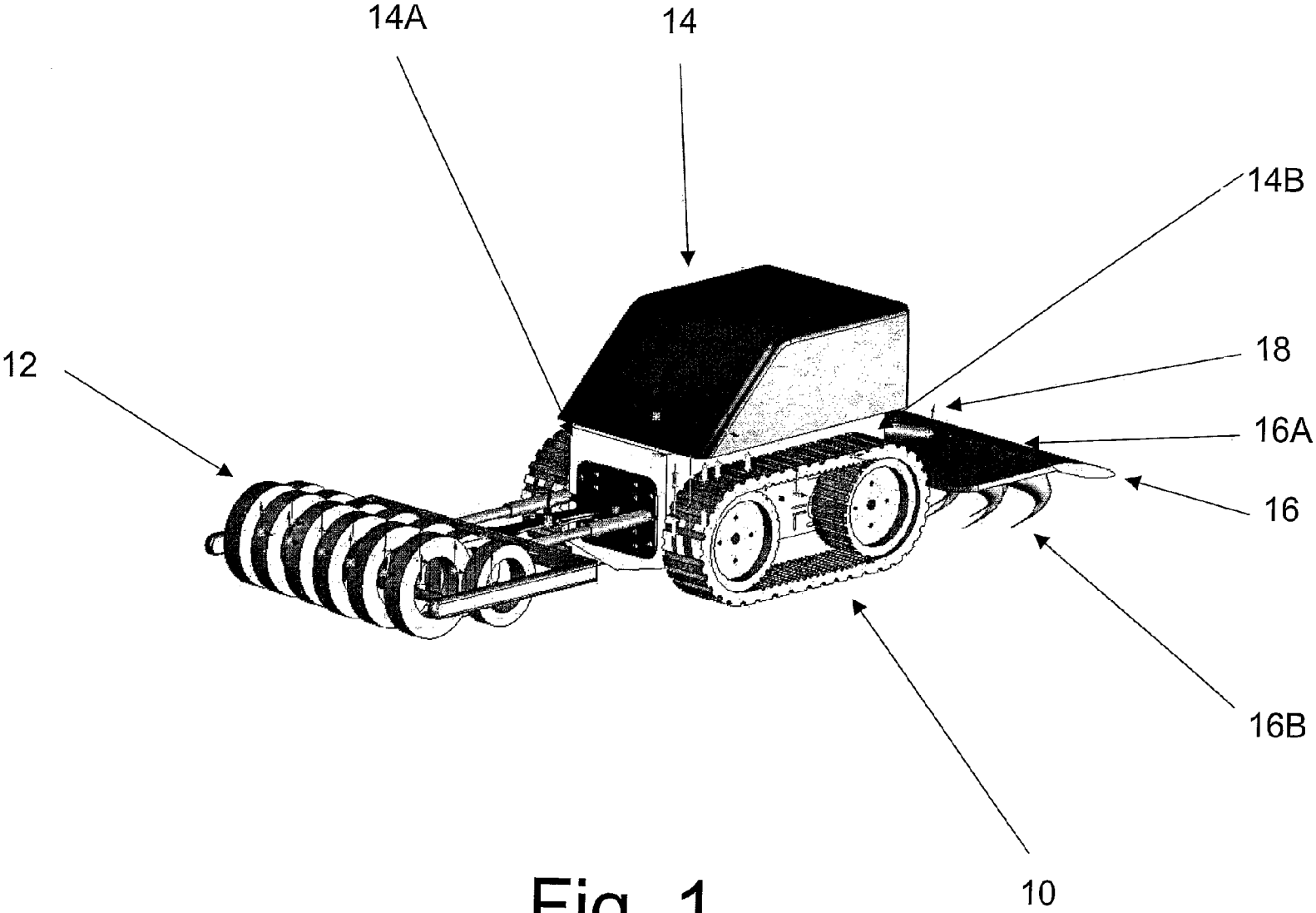
FIG. 1 is a perspective view of a full assembly of a mine-clearing apparatus showing a mine detonator, an unmanned propulsion unit, and an electromagnet member-rake member combination, according to an embodiment of the present invention.

Referring to FIG. 1 there is shown a complete assembly of a remotely controlled apparatus 10 for clearing mines located in or underneath a ground surface, in accordance with an embodiment of the present invention. The apparatus 10 comprises a mine detonator 12, coupled to first end 14*a* of an unmanned propulsion unit/device 14. The apparatus also comprises a rake member-electromagnet combination 16 coupled to a second end 14*b* of the unmanned propulsion unit 14 as shown.

Figure 2:
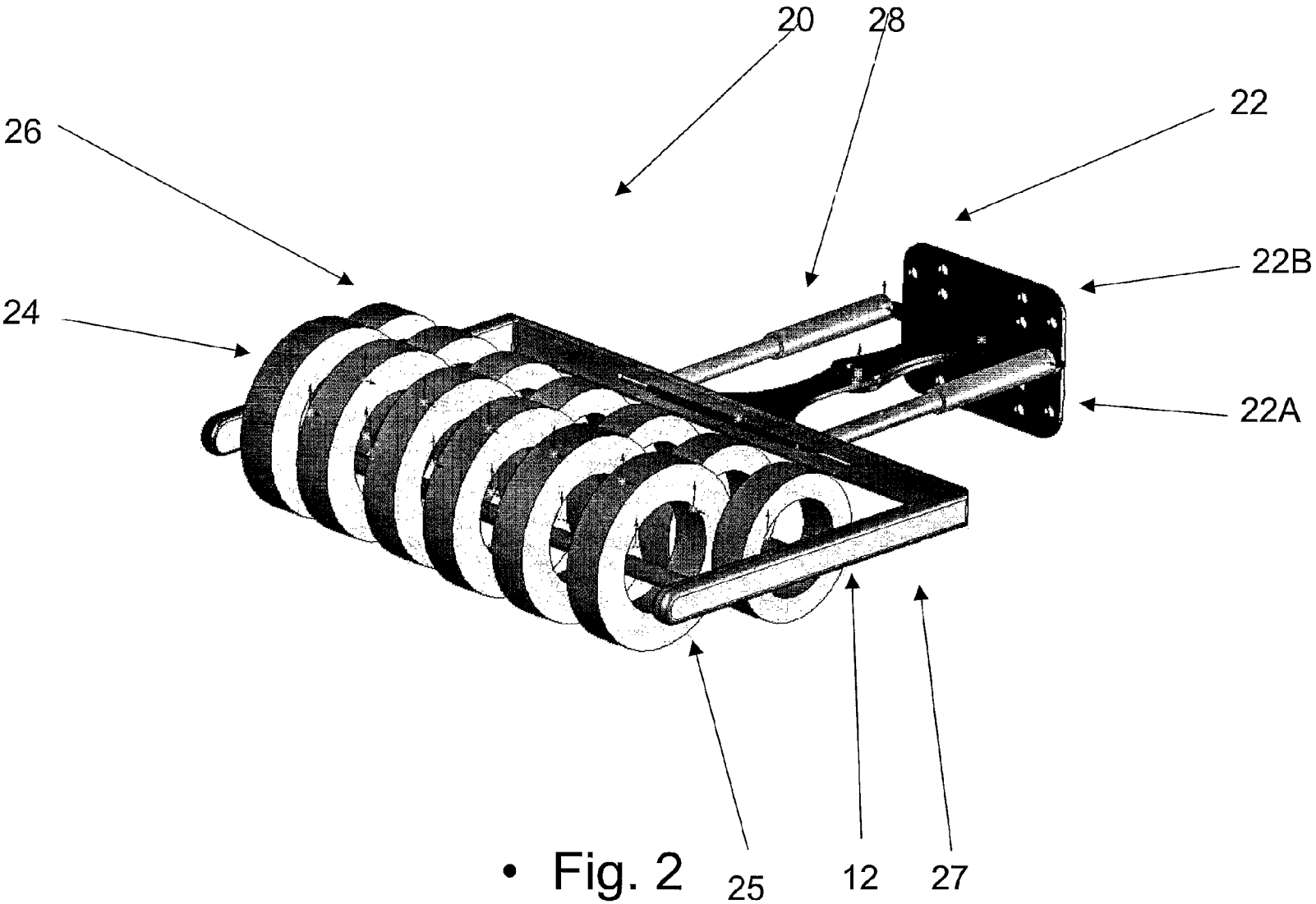
FIG. 2 is a perspective view of a roller assembly of the mine detonator, according to an embodiment of the present invention.

FIG. 2 of the present invention shows a perspective view of the mine detonator 12 in accordance with another embodiment of the present invention. The mine detonator 12 comprises a roller assembly 20 having at least one frame 22. The frame 22 preferably is made of steel having at least two sides, a first side 22*a* and a second side 22*b*. The frame 22 functions to support the mine detonator 12 on its first side 22*a* and is coupled with the unmanned propulsion unit 14 on its second side 22*b*.

The roller assembly 20 further comprises at least one cylindrical element formed of a roller disk 24 arranged concentrically along a roller axle 25 of the frame 22. The term "arranged concentrically" as used herein refers to an arrangement along the roller axle whereby both the roller disk 24 and the roller axle 25 have a common center. The roller disk 24 is mounted on a front arm of the roller axle 25 and axle array, and moves up and down on the axle 25 to compensate for changes in terrain. The roller disk 24 with a segmented column of weight functions to exert pressure on the ground surface. In a preferred embodiment, several cylindrical elements are installed so that they come in contact with each other. FIG. 2, preferably shows another cylindrical element formed of a back roller disk 26 positioned adjacent (meaning next to or adjoining) and in parallel to the front roller disk 24 and arranged concentrically along a roller axle 27 of the frame 22. The roller assembly 20 having one or more columns of roller disks has a greater probability of setting off a mine due to ground pressure then does a single column of rollers. In an alternate embodiment, roller disks 24 and 26 vary in size with different weight and circumference. As known in the art, the term "circumference" as used herein refers to the size of the disk measured by the distance around it. Preferably, the back roller disk 26 of the roller assembly 20 is smaller in circumference than the front roller disk 24. Although smaller rollers have a greater chance of detonating mines because a greater portion of their surface area touches the ground, they also are more likely to create a bow wave of earth in front of the roller that can inhibit rolling, especially in damp soils. A bow wave is the wave of material that forms in front of the roller, as soil is pushed down, some is pushed forward, forming a mound of material that behaves much as a wave yet is made out of soil, not water, and causes an obstacle to the roller. Bow wave, in the case of soil, involves the ground being pushed up into a wave of soil that serves at times to block the roller from moving forward or creates uneven skipping of the roller as it surmounts the wave. The larger disks of the front roller column are intended to exert pressure without the bow-wave effect, while the back rollers are more effective for hitting and detonating mines.

In comparison to the Pearson segmented roller system and or any other prior art device, as discussed above, the design of the present invention mounts disks 24 and 26 over two axles 25 and 27 respectively. This creates two distinct advantages. The first is that it creates space between the disks to allow explosive energy to escape unimpeded, lessening damage to the roller and total tool assembly. The spaces between the roller disks allow the force of the mine blast to pass up through the roller assembly during a mine detonation. This configuration will exert less stress on the device of the machine when mines are detonated. This has a favorable effect on long term maintenance as well as in dealing with larger mines. The second advantage is that it allows for disks of different weight and circumference to be mounted on the same array, with larger disks in front to prevent bow waves generated by the disks pushing at the earth, and smaller disks preferably in the rear to magnify ground pressure over a smaller contact patch, which allows each disk to slip more easily in and out of depressions (holes) in the terrain.

Although, only two cylindrical elements are shown in the roller assembly as depicted in FIG. 2, it is important to note that preferably there may be more than two cylindrical elements of various sizes in the roller assembly. In an alternate embodiment, for example, there preferably may be several cylindrical elements arranged concentrically along a single roller axle. Furthermore, in an alternate embodiment, the cylindrical elements 24 and 26 preferably may be arranged in an interlocking fashion with cylindrical elements of different sizes. As used herein, the term "interlocking arrangement" refers to a way in which parts of the roller assembly are arranged whereby cylindrical elements 24 and 26 are securely connected to each other such that each element 24 or 26 affects the other element 24 or 26 when in motion or operation. The frame 22 of the present invention also includes roller arms 28 connecting the roller assembly 20 to an unmanned propulsion unit 14, preferably to the first end 14*a* as shown.

Thus, the apparatus 10 of the present invention is a remotely controlled rolling system that includes a segmented roller of two interlocking columns to aid demining operations. Rollers often are propelled by an expensive machine that will be greatly damaged if it hits a mine that is missed by the roller. The apparatus 10 of the present invention is different in this regard in that it can be driven into a minefield and not simply used on the edge of the minefield.

The mine detonator 12 of the present invention is propelled by an unmanned propulsion unit 14, preferably a prime mover 30 of FIG. 3. The second side 22*b* of the frame 22, i.e., the side that is not supporting the roller mechanism 20, functions to couple with the prime mover 30. Internal components of the prime mover 30 are engineered to achieve the greatest amount of simplicity and lightest possible weight. The prime mover 30 has three structural characteristics. First, its weight differs from the weight of the roller assembly 20. The prime mover 30 can be lighter or heavier in weight than the roller assembly 20. In a preferred embodiment, the prime mover 30 is lighter than the roller assembly 20. Second, it employs a wheel assembly preferably made of steel that form the basis for a system of tracks, and third, it has an armored undercarriage.

These three characteristics work to ensure that damage to the device 10 will be minimal if a missed mine is detonated by the prime mover. Such damage is an issue in rolling operations and is a factor that keeps rollers from being used for more than simple area reduction.

Figure 3A:
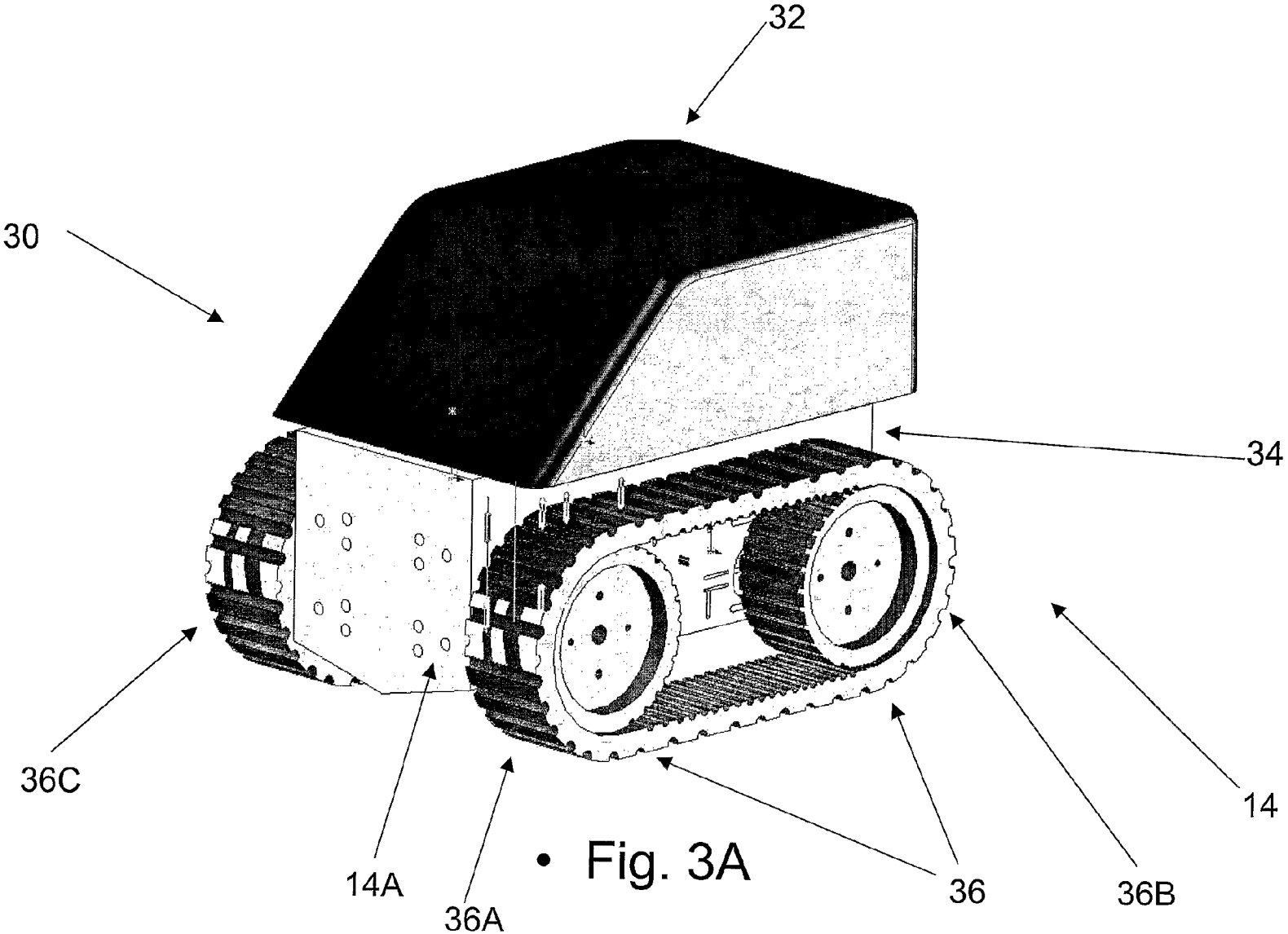
FIG. 3A is a perspective view of a prime mover of the unit displaying a first end, according to an embodiment of the present invention.

In another embodiment, the prime mover 30 as shown in FIG. 3A and FIG. 3B includes a platform 32 having an armored undercarriage 34 that supports adjustable weight stacks. The adjustable weight stacks function to vary the weight of the prime mover 30 depending on the conditions of the minefield. According to this embodiment, the apparatus 10 may be weighted in response to different applications and terrains. For instance, in conditions where the prime mover 30 has trouble getting traction, a demining crew can increase the weight to transfer more torque to the ground. As shown in FIG. 3A and FIG. 3B, the prime mover 30 comprises a wheel assembly 36, preferably made of steel. The wheel assembly 36 preferably includes four wheels 36*a*, 36*b*, 36*c* and 36*d* with a pair of wheels 36*a* and 36*b* located on the left side of the mover 30 and a second pair of wheels 36*c* and 36*d* located on the right side of the prime mover 30. Also, an undercarriage propelled by at least one high-torque motor, (not shown) functions to engage, and therefore power, the wheel assembly 36. In the prime mover 30, the motors are generally mounted in the middle of the body, one for each side. They sit in the middle, and are attached to a chain that links them to the axles of each wheel. In this configuration, preferably one motor powers two wheels, one for each side. This allows "tank steering" by modulating the power to each motor to control the set of wheels particular to each side. Each motor is configured in such a way that power can be modulated between motors. An alternative embodiment includes one motor capable of modulating (meaning adjusting or changing) power between the wheels 36. In each of these embodiments, the wheels 36 are capable of turning at different speeds relative to each other. A variety of methods are available to power the separate, high torque motors powering each wheel. These include internal combustion, hydraulics or electricity. Such options are within the knowledge of a person of ordinary skill in the art. It is anticipated that each end user will select the means to power the motors according to the end user's needs and the availability of the most advantageous powering means to that end user.

In another embodiment, separate, high torque electric motors powering each wheel are powered by a petroleum-powered generator of electricity mounted on the prime mover itself, much like a locomotive engine. Alternatively, the motors are powered by several rechargeable batteries. These batteries would need to be recharged after a certain period of use, but provide considerable simplicity.

In a preferred embodiment, there is provided only two motors each of which controls the each pair of wheels respectively. That is, first motor may preferably control the pair of wheels 36*a* and 36*b* on the left side of the mover 30 and the second motor may preferably control the pair of wheels 36*c* and 36*d* on the right side of the mover 30. This allows for smoother steering of the device compared with a device having four motors. The use of two electric motors, which are much easier to repair and maintain than are traditional internal combustion engines/transmissions, greatly simplifies the design of the prime mover, and is preferred.

The motors are interfaced at a central hub (not shown) that delegates more or less power to each motor in order to turn the machine. The central hub is controlled by a remote control device in the hands of a demining professional operating it at a safe distance.

The use of electric motors in high traction/high torque applications is not new. The successful use of electric motors goes back over a century to the invention of the hybrid electric car by Ferdinand Porsche. After World War II, diesel generators powering electric motors became commonplace in locomotives generating approximately 19,000 bhp (boiler horsepower units) and in being able to move incredible amounts of weight, considering the unique abilities of an electric motor's torque curve (i.e., it gets all of its torque at 1 rpm). Hybrid drives have been used in all manner of heavy construction and mining equipment where it would be nearly impossible to transfer the required amount of toque with a regular transmission, especially at low speeds. Given their past and current industrial applications, electric motors, if designed properly into the vehicle, provide the required performance levels needed for a demining machine. According to one embodiment of the invention, electric motors that individually have the capacity to push approximately 7,000 pounds are employed. This is more than enough power to enable the device to perform the tasks it has been designed to perform.

Figure 4A:
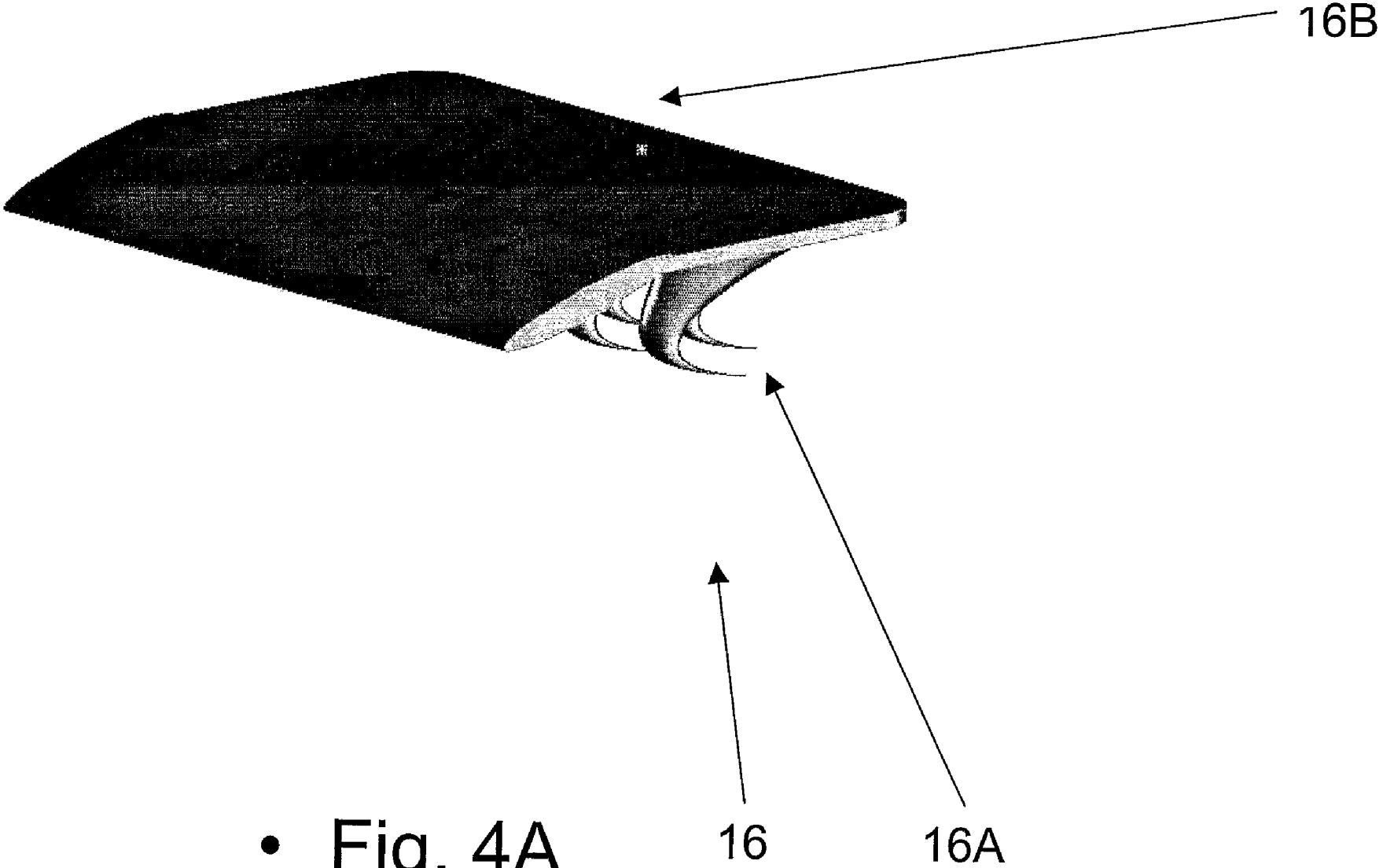
FIG. 4A is a perspective top view of an electromagnet member-rake member combination, according to an embodiment of the invention.
Figure 4B:
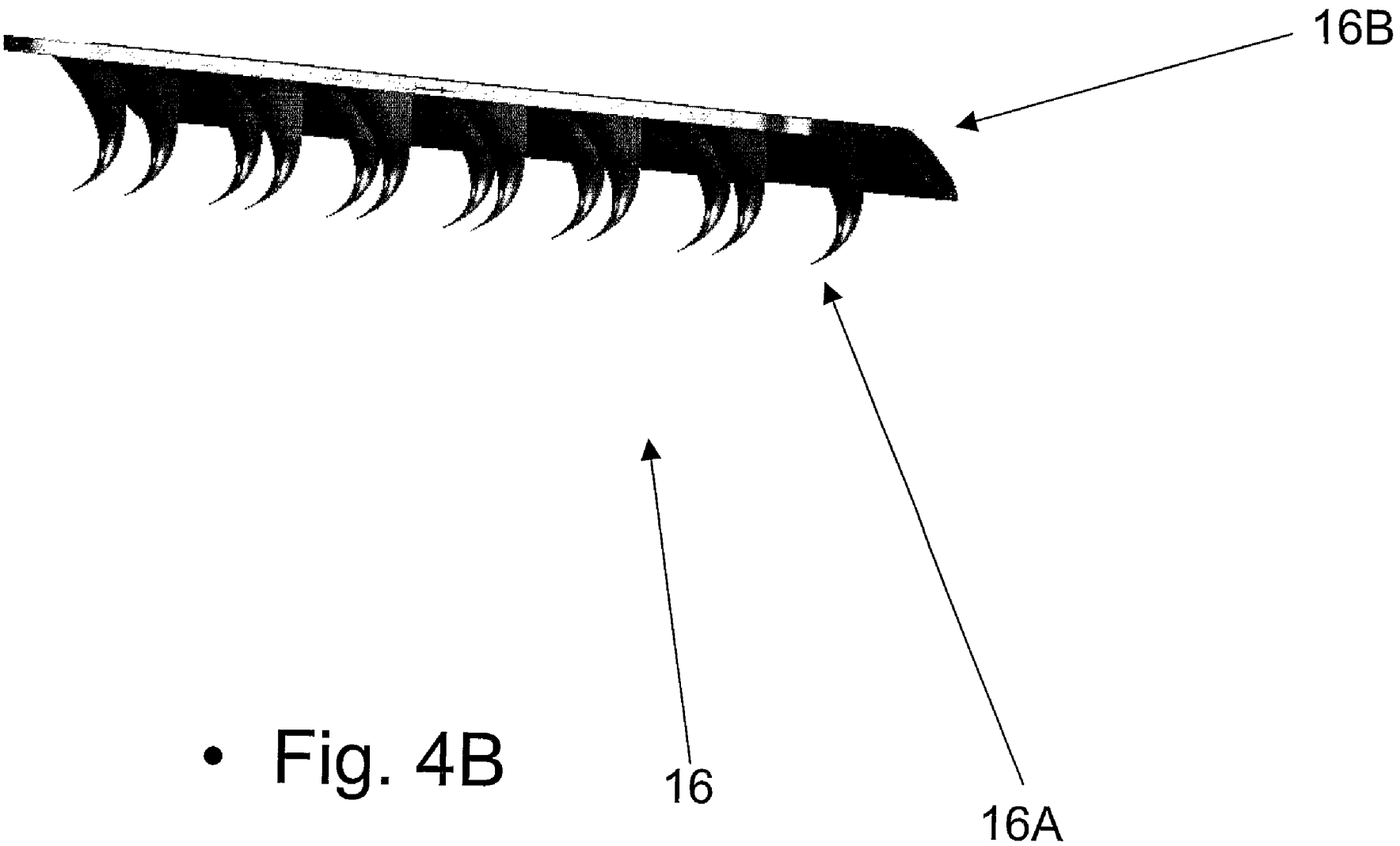
FIG. 4B is a perspective bottom view of an electromagnet member-rake member combination, according to an embodiment of the invention.

In addition to the described mine detonator 12 and the unmanned propulsion unit 14, the apparatus 10 also comprises the rake member-electromagnet combination 16 is securely connected (i.e., firmly tightened to join or fasten together) to the second end of the propulsion unit 14, preferably by a rod member 18 as shown in FIG. 1. FIG. 4A shows a perspective top view of the combination 16 and FIG. 4B shows a perspective bottom view of the combination 16. The rake member-electromagnet combination 16 comprises an adjustable rake member 16*a* and an adjustable or flexible electromagnet member 16*b*. The rake member as shown in FIG. 4B comprises rake teeth to turn up soil as the prime mover 30 advances in a minefield. The rake member 16*a* acts much like tractor-mounted rakes currently used in many farming operations to turn up soil. It churns up the surface of the terrain by disturbing and exposing both ground metal and metal beneath the surface. The electromagnetic member 16*b* picks up any metal on the minefield to reduce the occurrence of false metal signals for manual demining crews. The rake member-electromagnet combination 16 has an adjustable height and preferably has the same or substantially equivalent width as the roller mechanism 12. The term "substantially equivalent" is used herein to mean essentially equal in value to a great extent or degree. Accordingly, a user can raise the rake member-electromagnet combination 16, thereby raising the rake member 16*a* during the initial passes of the device in order for the electromagnet member 16*a* to pick up surface metal with the electromagnet member 16*b*. However, the user can later lower the rake member-electromagnet combination 16, thereby lowering the rake member 16*a* in order to turn the soil and to pick up sub-surface metal. Thus, the roller disks 24 and 26 are pushed by the prime mover 17, which also tows the rake member-electromagnet combination 16.

The apparatus 10 of the present invention, as described herein, has several advantages over previously available devices, including, but not limited to the following:

First, the apparatus 10 is much smaller and compact than existing solutions, and therefore is much more practical to transport within third-world infrastructures. Second, the remote control concept is much safer for the operator when compared with a machine that is operated by a deminer that has to drive through a minefield. Third, the use of different sized roller-disk columns prevents the bow-wave effect. Fourth, because the prime mover as disclosed is not an expensive piece of machinery compared to many existing devices, replacement or repair costs will be less should the device set off an anti-tank mine. Fifth, the prime mover is lighter in weight than the roller assembly, which means that there is less chance of the prime mover detonating mines missed by the roller disks. Sixth, if the weight of the prime mover needs to be adjusted, this can be done easily by adding or removing weights from the designated area on the top of the prime mover. Seventh, the electromagnet member of the rake member-electromagnet combination 16 removes both surface and sub-surface metal. The Geneva International Center for Humanitarian Demining cites metal as a major factor that makes mine clearance slower. If the present device is used before manual deminers are deployed, prior removal of surface and sub-surface metal will significantly speed up manual clearance. Eighth, the described apparatus is the only roller apparatus that incorporates a method for ground preparation in the same module. The use of a rake member brings metal and mines to the surface and enables more metal to be removed both on or underneath the surface when the device is driven over the same path multiple times. As used, the rake member also makes subsequent manual demining much faster: because the soil will already be loose, a manual deminer will have an easier time digging through suspect soil. Many industrial experts are partial to expensive flails for ground preparation for manual demining, but the presently described rake member will have a similar effect on the ground at a much lower price. A flail, as commonly known, is a manual threshing device consisting of a long wooden handle or a staff and a shorter, free swinging stick attached to its end. Ninth, the apparatus can be operated by someone with little training in machine operation. Tenth, the design of the prime mover is so simple that maintenance time and costs are significantly less than with currently solutions. Because repair and maintenance is not difficult on such a simple device, this function requires a non-specialist and does not cost as much as for many machines currently on the market. Eleventh, use of this apparatus where conditions permit gives an organization the ability to allocate its more expensive machines to tasks where their advanced capabilities truly can be leveraged while clearing more land at a faster pace and a lower cost.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described. All publications mentioned herein are incorporated herein by reference to disclose and describe the methods and/or materials in connection with which the publications are cited.

It must be noted that as used herein and in the appended claims, the singular forms "a", "and", and "the" include plural referents unless the context clearly dictates otherwise. All technical and scientific terms used herein have the same meaning.

Publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates, which may need to be independently confirmed.

It should be understood by those skilled in the art that various changes may be made and equivalents may be substituted without departing from the true spirit and scope of the Invention. In addition, many modifications may be made to adapt a particular situation, material, composition of matter, process, process step or steps, to the objective, spirit and scope of the present invention. All such modifications are intended to be within the scope of the claims appended hereto.

What is claimed is:

1. An apparatus for clearing land mines, comprising:

an unmanned propulsion device having a first end and a second end;

a mine detonator coupled to the first end of the unit for detonating mines located at or near a ground surface; and a rake member-electromagnet unit coupled to the second end of the unit;

wherein the apparatus is operated by a remote control.

2. The apparatus of claim 1 wherein the mine detonator comprises a frame having a first side and a second side.

3. The apparatus of claim 2 wherein the detonator further comprises a roller assembly supported by the first side of the frame.

4. The apparatus of claim 3 wherein the roller assembly comprises:

at least a first cylindrical roller and a second cylindrical roller positioned to come in contact with the first cylindrical roller, the first cylindrical roller mounted concentrically along a first crosspiece of the first side of the frame and the second cylindrical roller mounted concentrically along a second crosspiece of the first side of the frame.

5. The apparatus of claim 4 wherein the second cylindrical roller interlocks with the first cylindrical roller.

6. The apparatus of claim 4 wherein the first cylindrical roller having a circumference different from the circumference of the second cylindrical roller.

7. The apparatus of claim 3 wherein the roller assembly comprises:

at least a first cylindrical roller and a second cylindrical roller positioned adjacent the first cylindrical roller, the first cylindrical roller mounted concentrically along a first crosspiece of the first side of the frame and the second cylindrical roller mounted concentrically along a second crosspiece of the first side of the frame, wherein a space separates the first and the second cylindrical rollers.

8. The apparatus of claim 2 wherein the unmanned propulsion unit is coupled at the second side of the frame.

9. The apparatus of claim 1 wherein the unmanned propulsion unit comprises a prime mover having at least a platform with an armored undercarriage.

10. The apparatus of claim 1 wherein the rake member-electromagnet combination having a width substantially equivalent to a width of the mine detonator.

11. The apparatus of claim 1 wherein the rake member-electromagnet combination comprises a magnetic member and a rake member securely connected to the magnetic member.

12. The apparatus of claim 11 wherein the rake member comprises rake teeth to turn up soil on the ground surface.

13. The apparatus of claim 11 wherein the magnetic member picks up metals on the ground surface.

* * * * *